US005794767A

United States Patent [19]

Wilson

[11] Patent Number: 5,794,767

[45] Date of Patent: Aug. 18, 1998

[54] GRIPPING HOLDERS

[76] Inventor: Earl Wilson, 1025 Wainwright Dr., Oviedo, Fla. 32765

[21] Appl. No.: 868,563

[22] Filed: Jun. 4, 1997

Related U.S. Application Data

[63] Continuation-in-part of Ser. No. 549,250, Oct. 27, 1995, abandoned.

[51] Int. Cl.[6] ..... F21V 33/00

[52] U.S. Cl. ..... 206/37; 206/459.5; 401/88

[58] Field of Search ..... 206/37, 38, 234, 206/242, 85–87, 459.5; 220/737, 739; 431/144; 401/6, 88; 40/324

[56] References Cited

U.S. PATENT DOCUMENTS

| | | | |
|---|---|---|---|
| 1,376,115 | 4/1921 | Record . | |
| 1,395,793 | 11/1921 | Broschart . | |
| 1,879,456 | 9/1932 | Parsons . | |
| 2,173,451 | 9/1939 | Lorber . | |
| 3,137,956 | 6/1964 | Morgan | 40/324 |
| 3,763,996 | 10/1973 | Shepherd . | |
| 4,123,179 | 10/1978 | Pacheco . | |
| 4,205,367 | 5/1980 | Arnold . | |
| 4,230,224 | 10/1980 | Weeks . | |
| 4,601,598 | 7/1986 | Schwartz . | |
| 4,727,890 | 3/1988 | Vincent . | |
| 4,745,661 | 5/1988 | Wainscott . | |
| 4,750,613 | 6/1988 | Kopp . | |
| 4,852,729 | 8/1989 | Conte . | |
| 4,894,812 | 1/1990 | Wood . | |
| 4,973,177 | 11/1990 | Rose . | |
| 5,031,803 | 7/1991 | Chen | 40/324 |
| 5,056,945 | 10/1991 | Klodt . | |
| 5,293,715 | 3/1994 | Kaz | 40/324 |
| 5,325,959 | 7/1994 | Goldberger . | |
| 5,366,070 | 11/1994 | Wolov . | |
| 5,378,522 | 1/1995 | Lagomarsino . | |

*Primary Examiner*—Paul T. Sewell
*Assistant Examiner*—Luan K. Bui
*Attorney, Agent, or Firm*—Law Offices of Brian S. Steinberger; Brian S. Steinberger

[57] ABSTRACT

Gripping holders are described for cigarette lighters. The embodiments include small rubber hollow shaped cylinders, oblong shaped cylinders and oval bands that have preselected lengths, diameters and thicknesses sized to stretch about and tightly grip outer circumferences of cigarette lighters. Another version of the gripping holder has two rectangular rubber sheets creating a sandwich about two side-by-side magnets. Folding sandwich sheets about money bills so that the magnets attract one another creates a money clip gripper holder. The pocket type items with gripping holders do not slide out of shirt pockets nor slide from a pants pockets. The outer surfaces of the small rubber gripping holders can be smooth, have ridges, raised rings, finger shaped indentions and have other grooved shapes. The nonslip rubberized surfaces of the gripper holder are an aid against pickpockets. An extra option includes adhering Velcro® type hook and loop fastener patches to the sides of these gripping holders in order to allow for the gripping holders to be attachable and detachable to one another. Another embodiment has cut-out letters spelling SLIPPER GRIPPER on the long parallel sides of an oval cigarette lighter band.

10 Claims, 8 Drawing Sheets

150

Fig. 11B
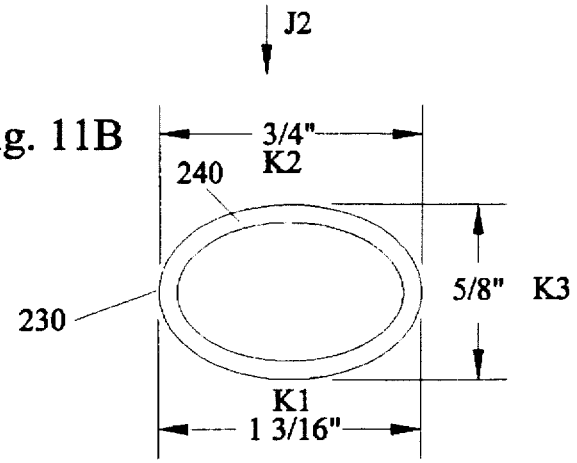
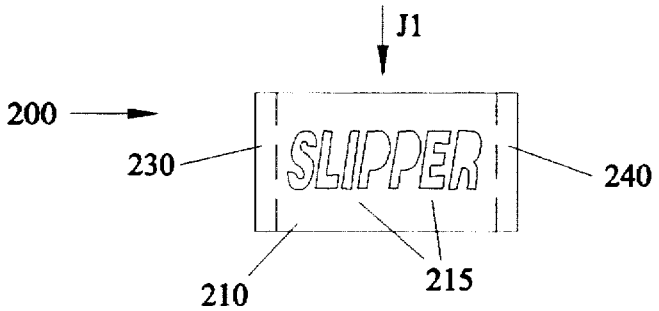
Fig. 11A
Fig. 11D
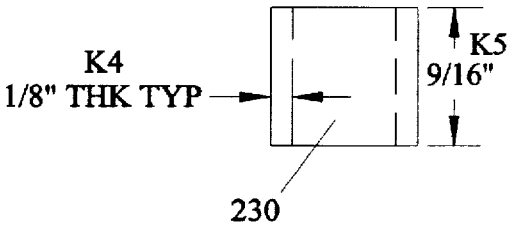
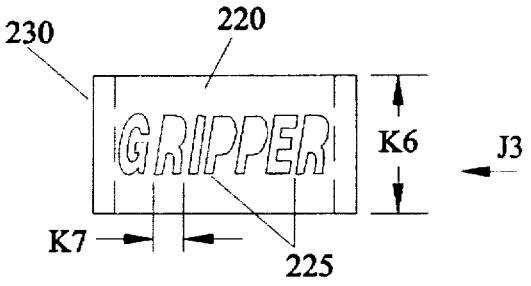
Fig. 11C

GRIPPING HOLDERS

This invention relates to resilient non-slip device holders, and in particular to cylindrical rubber holders that are sized to fit and grip about the circumference of disposable cigarette lighters, pens, pencils, wallets, eyeglass cases, remote controls, and compact portable telephones. This application is a Continuation-In-Part of Ser. No. 08/549,250 filed on Oct. 27, 1995, by the same inventor thereof, now abandoned.

BACKGROUND AND PRIOR ART

Because of their smooth shiny hardened outer surface, handheld cigarette lighters have been known to slip from a person's shirt pocket when the person is leaning over. Likewise, those same items can fall out of a pants pocket after the person has taken items from their pocket such as change. Often times these lighters must be replaced. Thus, the loss of the lighter can be both a nuisance and unneeded expense. Several devices have been attempted that can hold cigarette lighters. See U.S. Pat. Nos.: 3,763,996 to Shepherd; III, 4,750,613 to Kopp; and 4,727,890 to Vincent; 4,852,729 to Conte. However, these devices require that the lighter be attached to a large, cumbersome and undesirable boxlike container that further houses a pack of cigarettes. U.S. Pat. No. 4,745,661 to Wainscott has a cord attachment and pliable clip for attachment to a lighter. However, this device requires the user to constantly have to pry open a spring loaded clip in order to secure the lighter. Further, the dangling chain/cord and clip can be undesirable both aesthetically as well as uncomfortable to the user. U.S. Pat. No. 4,205,367 to Arnold describes a permanent lighter socket holder for use with cigarette lighters in automobiles which does not have any practical use outside of the automobile. U.S. Pat. No. 4,230,224 to Weeks describes a tubular jacket sheath cover of plastic, leather or cloth that completely wraps around most of a lighter and can have Velcro patches and hooks to attach to a cigarette case. However, the Weeks patent is requires a thin sheath that must cover all of the lighter beneath the wick portion and fails to prevent the lighter from falling out of one's pocket and the like.

Because of their smooth shiny surfaces, other types of small implements such as but not limited to ball point pens, pencils, and other elongated writing implements often have the same problem and likewise can become lost since their outer surfaces allows the implement to freely slide out from a pocket and become lost. Likewise, smooth slippery outer surfaces of some wallets fall out of pockets under similar conditions. The smooth outer surface of many wallets also allows the wallet to be prone to pickpockets. Likewise, persons have been known to lose eye eyeglass cases, television remote controls, and compact portable telephones from their pockets because of their slippery surfaces.

SUMMARY OF THE INVENTION

The first objective of the present invention is to provide a gripping device for cigarette lighters that prevents the lighter from sliding and slipping out of a shirt or pants pocket.

The second object of this invention is to provide a holding device for cigarette lighters that reduces the possibility of losing the lighter.

The third object of this invention is to provide a gripping device for writing implements such as pens and pencils that prevents the writing implement from sliding and slipping out of a shirt or pants pocket.

The fourth object of this invention is to provide a holding device for writing implements that reduces the possibility of losing the writing implements.

The fifth object of this invention is to provide a gripping device for wallets that prevents the wallet from sliding and slipping out of a shirt or pants pocket.

The sixth object of this invention is to provide a holding device for wallets that reduces the possibility of losing the wallets.

The seventh object of this invention is to provide a gripping device for eyeglass cases, television remote controls, compact portable telephones and money that prevents those items from sliding and slipping out of a shirt or pants pocket.

The eighth object of this invention is to provide a holding device for eyeglass cases, television remote controls, compact portable telephones and money that reduces the possibility of losing those items.

The ninth object of this invention is to provide a holding device for pocket type items that aids in reducing pickpocketing of those items.

Embodiments for gripping small pocket held items such as lighters, pens, pencils, wallets, eyeglass cases, television remote controls, compact portable telephones, and money clips are disclosed. The preferred embodiments include small rubber hollow shaped cylinders that are specifically sized with definitive dimensions to stretch about and tightly grip small areas of these pocket type items. The outer surfaces of the small rubber cylinders can be smooth, have ridges, raised rings, finger shaped indents and other grooved shapes. Because of their nonslip surface, the rubber gripping holders can help prevent pickpocketing of those pocket items.

Another alternative option can include a small Velcro® patch having hook and loop fasteners adhered by glue and the like on each of the cylinders that allows the cigarette lighter cylinder gripper to be attachable and detachable to the pen cylinder gripper and/or attachable and detachable to other cylinder gripped pocket items and the money clip gripper holder.

Another preferred embodiment has the outer surface of the lighter completely covered with raised ¼ of an inch by ¼ inch squares inlaid over a rubber base that completely wraps about the body of a lighter. This embodiment can optionally include a bottom rubber cover that allows the device to be completely cup-shaped.

A still another preferred embodiment includes a rubber sleeve oblong cylindrical shape(somewhat oval) having spaced cut-out portions whose sharp inner edges allow the sleeve to frictionally rub against the smooth surface of a disposable lighter. The sleeve has optimum dimensions having wall thickness of approximately ⅛", a height of approximately 9/16", two parallel sides each having lengths of approximately ¾", curved end walls with an overall length between the end walls having a length of approximately 1&¾". Each of the cut-out letters can have a height of up to approximately 7/16", widths of up to approximately 1/16", with seven cutout letters on each long side of the sleeve.

Further objects and advantages of this invention will be apparent from the following detailed description of a presently preferred embodiment which is illustrated schematically in the accompanying drawings.

BRIEF DESCRIPTION OF THE FIGURES.

FIG. 11A is a front side view of the thirteenth embodiment of the oblong cylindrical gripper sleeve with cut-outs for a disposable cigarette lighter.

FIG. 11B is a top view of the embodiment of FIG. 11A along arrow J1.

FIG. 11C is a rear side view of the embodiment of FIG. 11B along arrow J2.

FIG. 11D is an end view of the embodiment of FIG. 11C along arrow J3.

DESCRIPTION OF THE PREFERRED EMBODIMENT

Figure 1C:
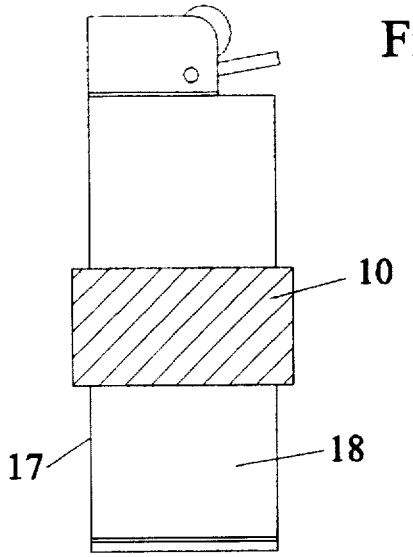
FIG. 1C is a perspective view of the gripping holder of FIGS. 1A–1B attached to a pocket lighter.
Figure 1A:
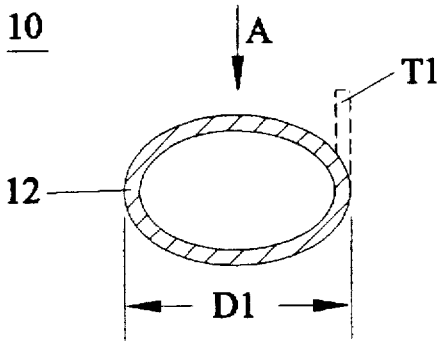
FIG. 1A is an end view of a first preferred embodiment of the gripping holder for a pocket lighter.
Figure 1B:
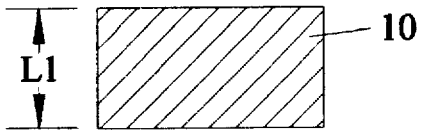
FIG. 1B is a side view of the gripping holder of FIG. 1A along the direction of arrow A.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation. Referring to FIGS. 1A–1C, the first embodiment gripping holder 10 can be formed from 100% natural rubber 12 having an outer diameter D1 of approximately 1 and ¼ inches, a thickness, T1 of approximately 1/10 of an inch, and a length, L1 of approximately 1½ inch. Holder 10 can be formed by injection molding and the like. Pocket lighter can be inserted into the hollow area 14 of the gripping holder 10. The size of the gripping holder allows for a tight snug fit about the outer circumference 17 of the lighter 18. The novel cylindrical rubber gripping holder 10 can stretch and tightly fit about lighters 18 which have outer skins 17 formed from plastic, ceramic, metal outer surfaces. Cigarette lighters 18 can be of different shapes and sizes. The rubber gripper 10 can fit disposable, refillable and mini lighters 10. Using the gripping holder 10 allows the lighter to be able to stay within a pants and shirt pockets of a user.

Figure 2A:
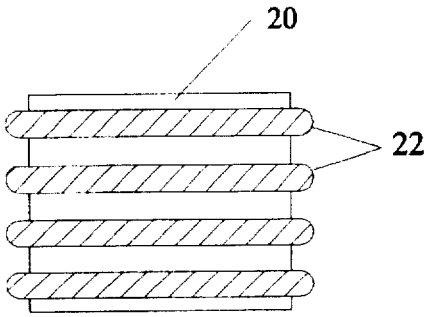
FIG. 2A is a side view of a second preferred embodiment of the gripping holder having a ringed ridged exterior outer surface.
Figure 2B:
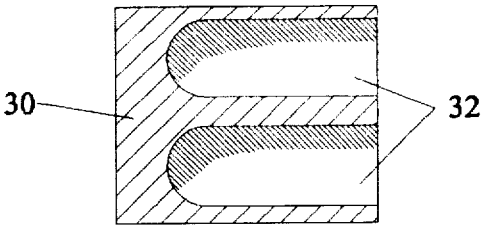
FIG. 2B is a front side view of a third preferred embodiment of the gripping holder having finger-shaped indentations on an exterior outer surface.
Figure 2C:
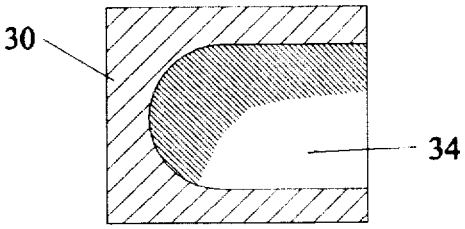
FIG. 2C is a rear side view of the third preferred embodiment of the gripping holder with finger indentations.

FIG. 2A is a side view of a second preferred embodiment of the gripping holder 20 having a raised ringed ridged exterior outer surface 22. FIG. 2B is a front side view of a third preferred embodiment of the gripping holder 30 having finger-shaped indentations 32 on an exterior outer surface. FIG. 2C is a rear side view of the third preferred embodiment of the gripping holder 30 with a thumb print indentation 34.

Figure 3:
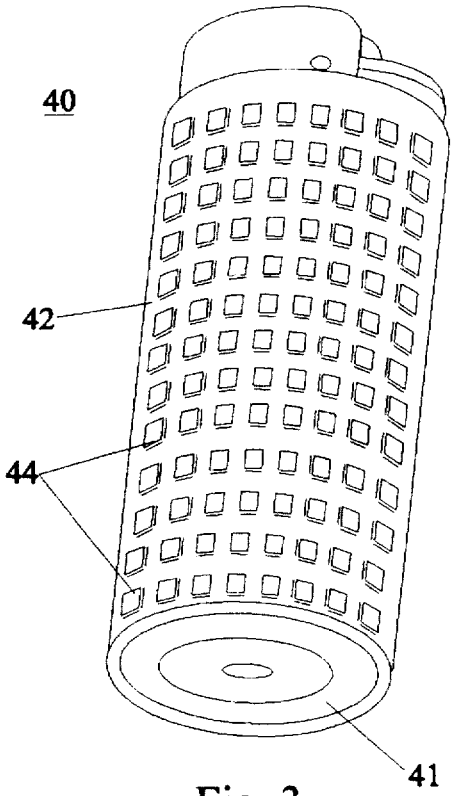
FIG. 3 is a perspective view of a fourth preferred embodiment of a lighter having an entire exterior surface with a novel gripping holder pattern.

FIG. 3 is a perspective view of a fourth preferred embodiment 40 of a lighter having an entire exterior surface with a novel gripping holder pattern that includes raised ¼ of an inch by ¼ of an inch rubber squares 44 overlying a rubber base 41 substantially covering the exterior of the lighter 41. Embodiment 40 can wrap about an existing lighter or alternatively be an exterior replacement for entire outer skin of lighter 41. Lighter 41 can be disposable, refillable and the like.

Figure 4:
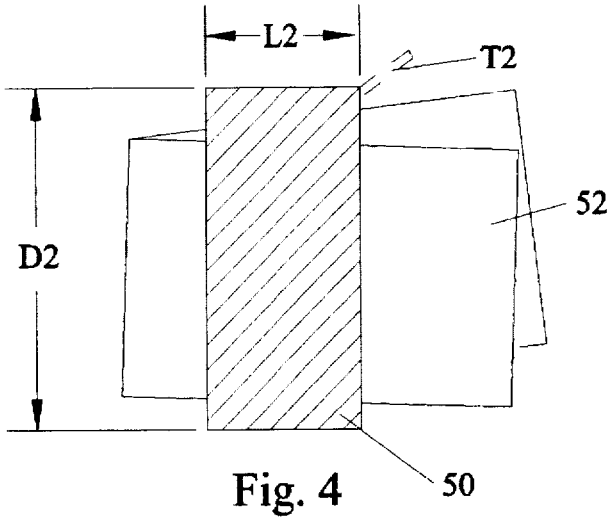
FIG. 4 is a fifth preferred embodiment of a gripping holder for wallets.

FIG. 4 is a fifth preferred embodiment of a gripping holder 50 for pocket wallets 52. Gripping holder 50 can have an outer diameter D2, up to approximately 3 and ⅜ of an inch, a band thickness T2, of approximately 1/10", and a length, L2 of approximately ⅝".

Figure 5:
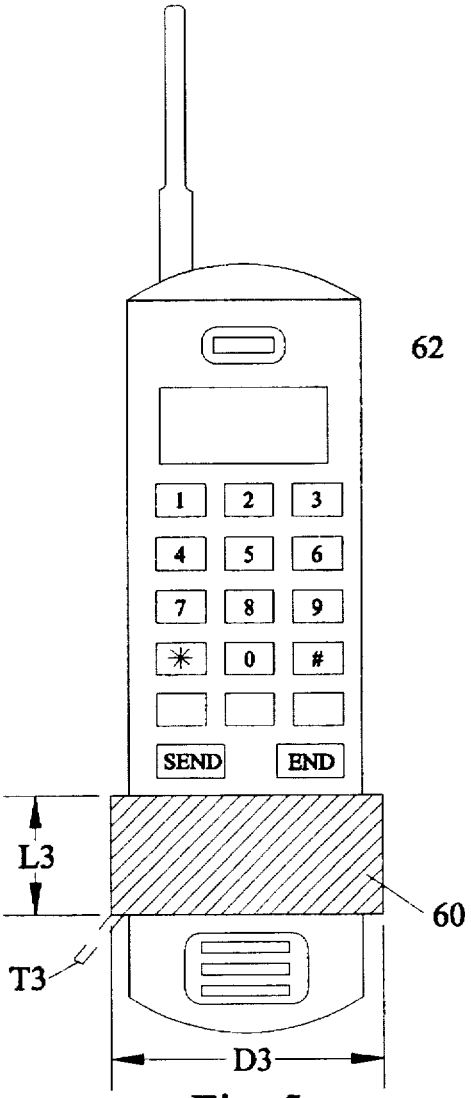
FIG. 5 is a sixth preferred embodiment of a gripping holder for pocket sized cellular telephones.

FIG. 5 is a sixth preferred embodiment of a gripping holder 60 for pocket sized cellular telephone 62. Gripping holder 60 can have an outer diameter D3, up to approximately 1 and ¾ of an inch, a band thickness T3, of approximately 1/10 of an inch, and a length, L2 of approximately ⅜ inches.

Figure 6:
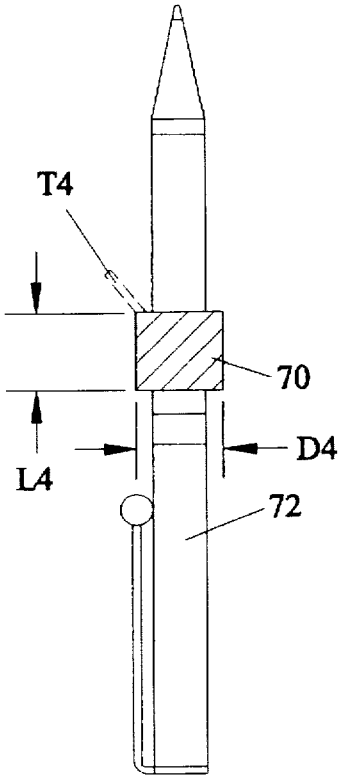
FIG. 6 is a seventh preferred embodiment of a gripping holder for pens and pencils.

FIG. 6 is a seventh preferred embodiment of a gripping holder 70 for writing implements 72 such as but not limited to pens and pencils. Gripping holder 70 can have an outer diameter D4, up to approximately 5/16 of an inch, a band thickness T4, of approximately 1/10 of an inch, and a length, L4 of approximately ⅜ inches.

Figure 7:
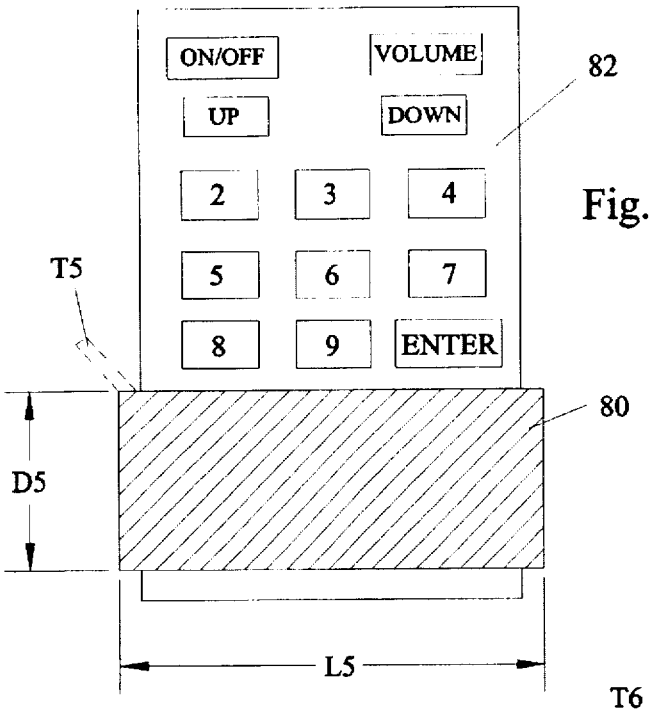
FIG. 7 is eight preferred embodiment of a gripping holder for television remote controls.

FIG. 7 is an eighth preferred embodiment of a gripping holder 80 for television remote controls 82. Gripping holder 80 can have an outer diameter D5, up to approximately 1 and ¾ inches, a band thickness T5, of approximately 1/10 of an inch and a length, L2 of approximately ⅜ of an inch.

Figure 8:
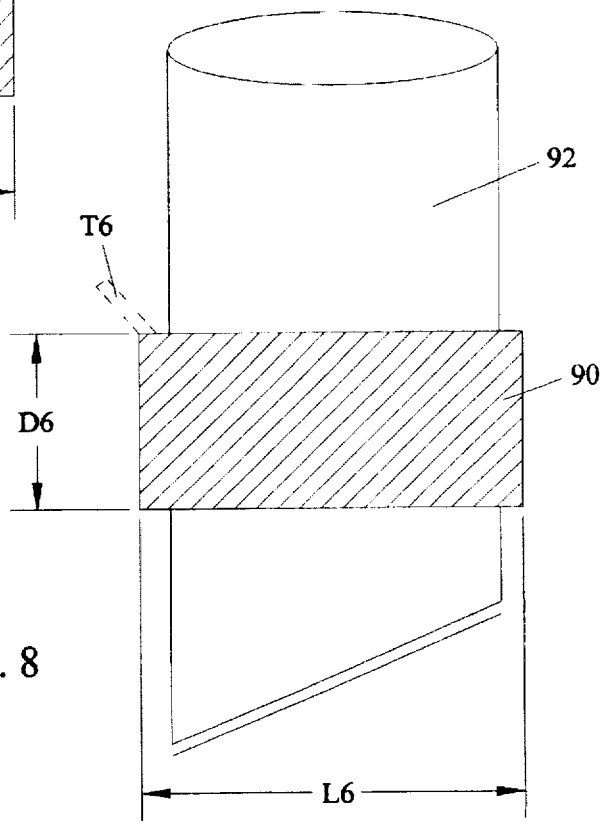
FIG. 8 is a ninth preferred embodiment of a gripping holder for eyeglass cases.

FIG. 8 is a ninth preferred embodiment of a gripping holder 90 for an eyeglass case 92. Gripping holder 90 can have an outer diameter D6, up to approximately 2 inches, a band thickness T6, of approximately 1/10 of an inch, and a length, L6 of approximately ½ inch.

Figure 9C:
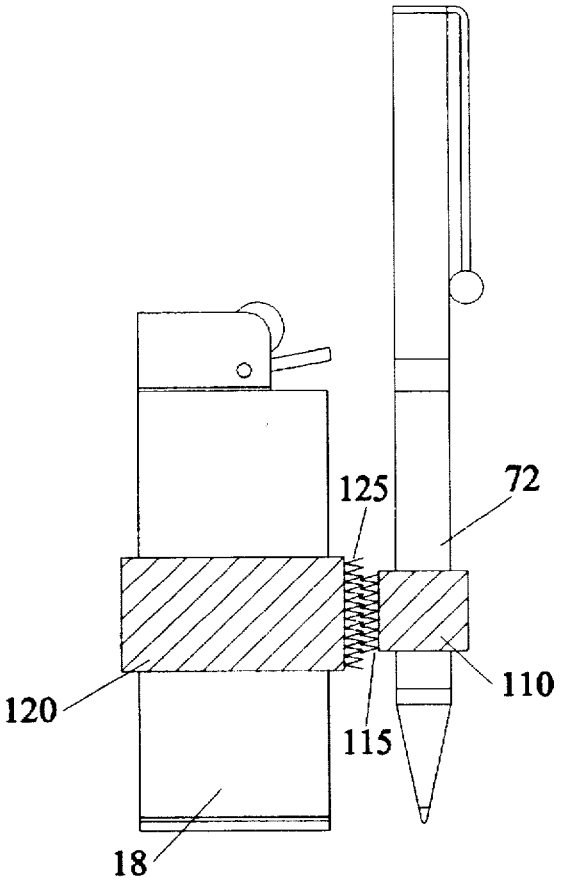
FIG. 9C a perspective view of the embodiments of FIGS. 9A–9B attached together and used with a lighter and pen.
Figure 9A:
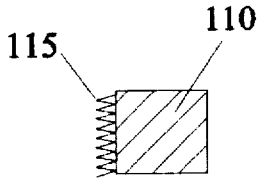
FIG. 9A is an tenth preferred embodiment of a pen/pencil gripping holder with hook and loop fasteners.
Figure 9B:
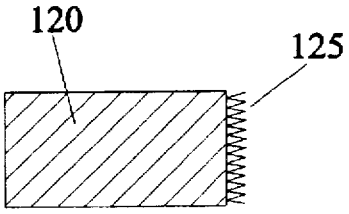
FIG. 9B is a eleventh preferred embodiment of a lighter gripping holder with hook and loop fasteners.

FIG. 9A is a tenth preferred embodiment of a pen/pencil gripping holder 110 with a hook and loop fasteners patch 115 adhered to one side by glue and the like. The hook and loop fasteners 115, 125 can be material such as but not limited to Velcro® and the like. Holder 110 is identical to the holder 70 previously described. FIG. 9B is a eleventh preferred embodiment of a lighter gripping holder 120 with a hook and loop fasteners patch 125 adhered to one side by glue and the like. FIG. 9C is a perspective view of the embodiments 110 and 120 of FIGS. 9A–9B attached together by their respective hook and loop fasteners which hold together a lighter 18 and pen 72.

Figure 10A:
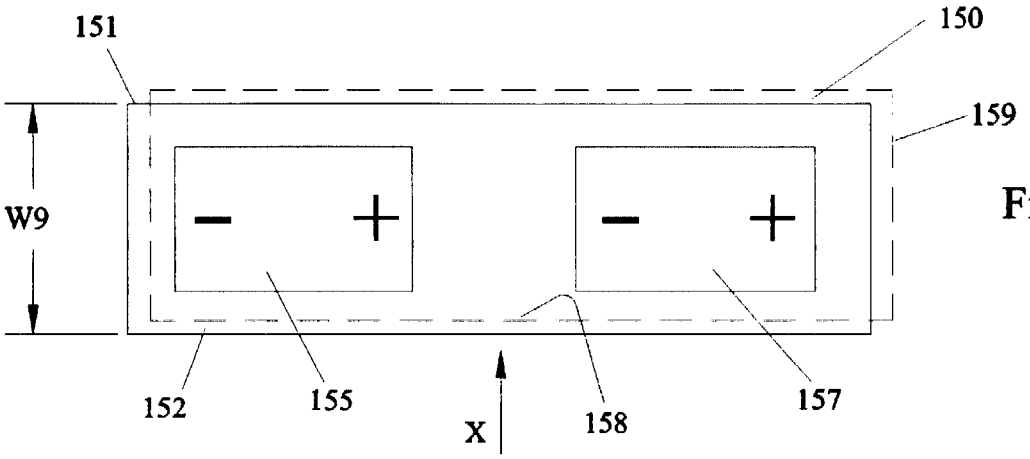
FIG. 10A is a plan view of a twelfth preferred embodiment of a money clip gripper holder.
Figure 10B:
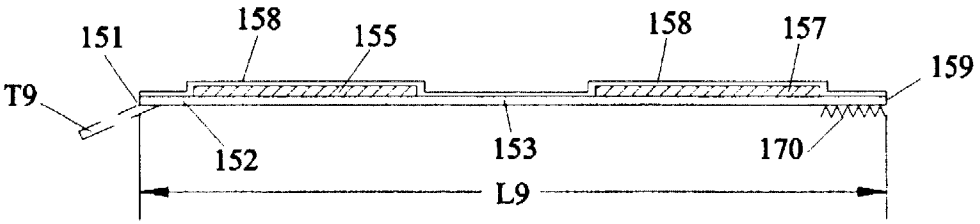
FIG. 10B is a side view of the embodiment of FIG. 10A along arrow X.
Figure 10C:
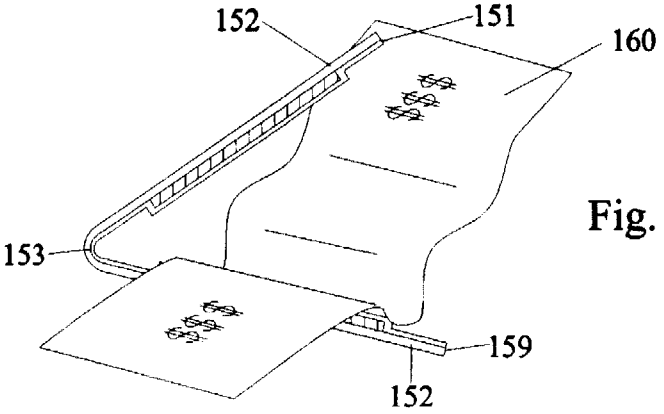
FIG. 10C is a perspective view of the embodiment of FIG. 10A in use.

FIG. 10A is a plan view of a twelfth preferred embodiment of a money clip gripper holder 150. FIG. 10B is a side view of the embodiment 150 of FIG. 10A along arrow X. FIG. 10C is a perspective view of the embodiment 150 of FIG. 10A in use. Each embodiment includes a lower sheet 152, an upper sheet 158 each formed from rubber type materials such as 100% natural rubber, rubber composite, and the like. Each sheet 152, 158 has a length, L9 of approximately 5 inches, a width, W9 of approximately 1 and ½ inches, and thicknesses, T9 of approximately 1/10 of an inch. Rubberized magnet materials 155 and 157 that can be sized at approximately 1 and ½ inches by 1 inches and approximately 1/10 inches thick, are sandwiched between sheets 152 and 158 and can be adhered together by glue, cement and the like. Ends 151 and 159 are folded together at point 153 and can act as a money clip to folded money type bills 160 together. Optional hook and loop fastener 170 can be adhered to one side of the sheets 152 by glue and the like, which enables the money clip gripper holder 150 to be attachable and detachable to the resilient rubber cylinders with their respective fastener patches that were discussed previously.

While the embodiments depicted in FIGS. 2A–2C show ringed ridges, finger and thumbprints on a gripper holder for lighters, these patterns can be used for the other gripper holders described above.

Further, although the embodiments depicted in FIGS. 9A–9C show Velcro® type fasteners on a gripper holder for lighters to be attachable and detachable from pen/pencil grippers, these fasteners can be used for attaching and detaching the other gripper holders described above from one another. Alternatively, plural Velcro® type patch can be adhered to each gripper holder.

FIG. 11A is a front side view of the thirteenth embodiment of an oval shaped gripper sleeve band 200 with cut-outs 215, 225 for slipping about a disposable cigarette lighter 280. FIG. 11B is a top view of the embodiment 200 of FIG. 11A along arrow J1. FIG. 11C is a rear side view of the embodiment 200 of FIG. 11B along arrow J2. FIG. 11D is an end view of the embodiment 200 of FIG. 11C along arrow J3. Referring to FIGS. 11A–11D, embodiment 200 includes a generally oval shape band that appears in the top view of FIG. 11B to be rectangular with curved end walls. The novel sleeve band a wall thickness, K4 of approximately ⅛", a height, k5 of approximately 9/16", two parallel sides 210, 220 each having lengths, k2, of approximately ¾", opposing curved end walls 230, 240 with an overall length between the end walls having a length k1, of approximately 1&¾". Each of the cut-out letters 215, 225 can have a height, k6, of up to approximately 7/16", widths, k7 of up to approximately 1/16". The preferred embodiment 200 has the word 215 "SLIPPER" cut through one side 210, and the word 225 "GRIPPER" cut-through the opposite side 220.

Figure 11F:
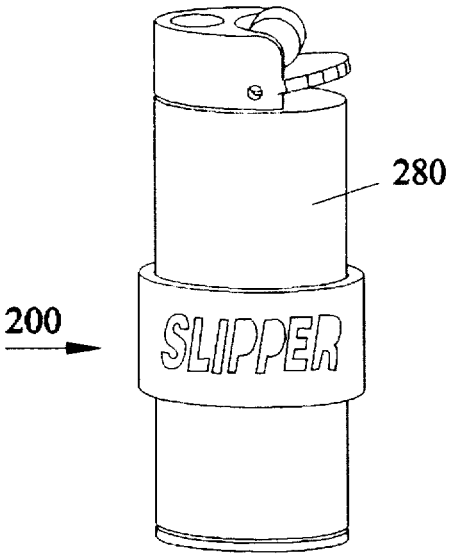
FIG. 11F is a perspective view of the sleeve of FIG. 11E attached to a disposable lighter.
Figure 11E:
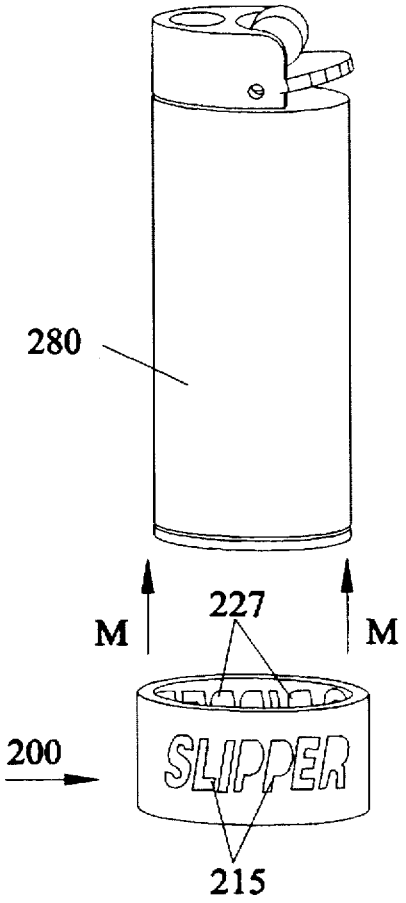
FIG. 11E is perspective view of the embodiment of FIG. 11A detached from a disposable lighter.

FIG. 11E is perspective view of the embodiment 200 of FIG. 11A detached from a disposable lighter 280. FIG. 11F is a perspective view of the sleeve band 200 of FIG. 11E attached to the disposable lighter 280 after being slipped on and the lighter in the direction of arrow M. The internal cut-out edges of the cut-through letters 227(only inner edges 227 of the word "GRIPPER" are shown for clarity) have ninety degree edges which frictionally abut up against the surface of lighter 280 increasing the gripping action of the novel band 200 to the lighter 280.

A still another preferred embodiment includes a rubber sleeve oblong cylindrical shape(somewhat oval) having spaced cut-out portions whose sharp inner edges allow the sleeve to frictionally rub against the smooth surface of a disposable lighter.

Although the preferred embodiments describe using 100% natural rubber, the gripping embodiments can alternatively be formed from other resilient materials such as but not limited to elastomers, rubber composite materials, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A gripping holder for a disposable cigarette lighter comprising in combination:

a disposable cigarette lighter having a smooth slippery surface; and an oval 100% rubber sleeve having two parallel sides having curved endwalls with an overall length between the endwalls being approximately 1 & 3/16", the sleeve having a height of approximately 9/16", the wall thickness of approximately ⅛", and equally distant spaced cut-out letters having heights of up to approximately 7/16" on each of the two parallel sides, the cut-out letters forming sharp internal edges on inner walls of the sleeve, wherein the sleeve when slipped over and about the lighter forms a tight grip on the lighter and prevents the lighter from sliding out from shirt pockets and pants pockets.

2. The gripping holder for a disposable cigarette lighter of claim 1, wherein the letters include:

seven letters on each of the two parallel sides.

3. The gripping holder for a disposable cigarette lighter of claim 2, wherein the letters further include:

the word slipper on one of the two parallel sides and the word gripper on the other of the two parallel sides.

4. The gripping holder for a disposable cigarette lighter of claim 1, wherein each the letters have widths of up to approximately 1/16".

5. The gripping holder for a disposable cigarette lighter of claim 1, wherein the two parallel sides have planar lengths of approximately ¾".

6. A thickened gripping band for a disposable cigarette lighter comprising in combination:

a disposable cigarette lighter having a smooth slippery surface; and an oblong oval stretchable preformed rubber band having dual opposing straight sides with curved endwalls, the band having a wall thickness of approximately ⅛", and equally distant spaced cut-out letters on each of the dual opposing sides, the cut-out letters forming sharp internal edges on inner walls of the band, wherein the band when slipped over and about the lighter forms a tight grip on the lighter and prevents the lighter from slipping and sliding out from shirt pockets and pants pockets.

7. The thickened gripping band for the disposable cigarette lighter of claim 6, wherein the letters include:

seven letters on each of the dual sides.

8. The thickened gripping band for the disposable cigarette lighter of claim 7, wherein the letters further include:

the word slipper on one of the dual sides and the word gripper on the other of the dual sides.

9. The thickened gripping band for the disposable cigarette lighter of claim 6, wherein each of the dual sides have planar lengths of approximately ¾".

10. The thickened gripping band for the disposable cigarette lighter of claim 6, wherein the band includes a height of:

approximately 9/16".

* * * * *